US011692253B2

(12) United States Patent
Oliver et al.

(10) Patent No.: US 11,692,253 B2
(45) Date of Patent: Jul. 4, 2023

(54) DUPLEX STAINLESS STEEL

(71) Applicant: Outokumpu Oyj, Helsinki (FI)

(72) Inventors: James Oliver, Fjärdhundra (SE); Jan Y. Jonsson, Avesta (SE)

(73) Assignee: Outokumpu Oyj, Helsinki (FI)

( * ) Notice: Subject to any disclaimer, the term of this patent is extended or adjusted under 35 U.S.C. 154(b) by 629 days.

(21) Appl. No.: 15/114,188

(22) PCT Filed: Feb. 2, 2015

(86) PCT No.: PCT/FI2015/050065

§ 371 (c)(1),
(2) Date: Jul. 26, 2016

(87) PCT Pub. No.: WO2015/114222

PCT Pub. Date: Aug. 6, 2015

(65) Prior Publication Data

US 2016/0369382 A1 Dec. 22, 2016

(30) Foreign Application Priority Data

Feb. 3, 2014 (FI) ..... 20145113

(51) Int. Cl.

| | |
|---|---|
| ***C22C 38/44*** | (2006.01) |
| ***C22C 38/58*** | (2006.01) |
| ***C22C 38/40*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |

(52) U.S. Cl.

CPC ..... *C22C 38/58* (2013.01); *C22C 38/001* (2013.01); *C22C 38/02* (2013.01); *C22C 38/04* (2013.01); *C22C 38/40* (2013.01); *C22C 38/42* (2013.01); *C22C 38/44* (2013.01); *C21D 2211/001* (2013.01); *C21D 2211/005* (2013.01)

(58) Field of Classification Search

CPC ..... C22C 38/44

See application file for complete search history.

(56) References Cited

FOREIGN PATENT DOCUMENTS

| | | | | |
|---|---|---|---|---|
| CN | 100999806 | A | 7/2007 | |
| EP | 1561834 | A1 * | 8/2005 | ..... C21C 7/0087 |
| EP | 2172574 | A1 | 4/2010 | |
| GB | 2166159 | A * | 4/1986 | ..... C22C 38/44 |
| JP | S52141414 | A | 11/1977 | |
| JP | S5325214 | A | 3/1978 | |
| JP | H03229839 | A | 10/1991 | |
| JP | H10102206 | A | 4/1998 | |
| JP | 2000313940 | A | 11/2000 | |
| JP | 2013253315 | A | 12/2013 | |
| WO | 03038136 | A1 | 5/2003 | |
| WO | 2013034804 | A1 | 3/2013 | |

OTHER PUBLICATIONS

McGuire, Michael F.. (2008). Stainless Steels for Design Engineers. ASM International, pp. 91-107. (Year: 2008).*

International Search Report prepared by the Finnish Patent and Registration Office for PCT/FI2015/050065, dated Apr. 15, 2015, 6 pages.

Written Opinion prepared by the Finnish Patent and Registration Office for PCT/FI2015/050065, dated Apr. 15, 2015, 5 pages.

JP2000313940 machine translation of the paragraphs [0001]—[0061] of the description retrieved Feb. 27, 2018 (8 pages).

JP2000313940 machine translation of Claims 1-5 retrieved Feb. 27, 2018 (1 page).

JPH03229839 machine translation of paragraphs [0001], [0002] and [0003] of the publication (3 pages).

JPH03229839 machine translation of claim 1 (1 page).

JPH10102206 machine translation of paragraphs [0001] through [0018] of the Description relieved on Feb. 27, 2018 (3 pages).

JPH10102206 machine translation of Claim 1 retrieved Feb. 27, 2018 (1 page).

JPS5325214A machine translation of paragraphs [0001] through [0003] of the description (2 pages).

JPS5325214A machine translation of claim 1 (1 page).

CN100999806A machine translation of paragraphs [0001] through [0047] of the description (6 pages).

CN100999806A machine translation of claims 1-6(1 page).

Extended European Search Report issued in Appl. No. 15743800.3 dated Aug. 21, 2017 (11 pages).

First Office Action issued by the State Intellectual Property Office of the People's Republic of China in Appl. No. CN 201580006966.9 dated Apr. 20, 2017, including English language translation (16 pages).

Notification of Reason for Refusal issued in Japanese Appl. No. 2016-549747 dated Aug. 8, 2017, including English language translation (18 pages).

Written Opinion of the International Searching Authority issued in International Appl. No. PCT/FI2015/050065, undated (3 pages).

* cited by examiner

*Primary Examiner* — Jophy S. Koshy
(74) *Attorney, Agent, or Firm* — Quinn IP Law

(57) ABSTRACT

A duplex ferritic austenitic stainless steel having high formability utilizing the TRIP effect and high corrosion resistance with the balanced pitting resistance equivalent is formed with less than 0.04 weight % carbon, 0.2-0.8 weight % silicon, less than 2.0 weight % manganese, 16.5-19.5 weight % chromium, 3.0-4.7 weight % nickel, 1.5-4.0 weight % molybdenum, less than 3.5 weight % tungsten, less than 1 weight % copper, 0.13-0.26 weight % nitrogen, the rest being iron and inevitable impurities occurring in stainless steels.

12 Claims, 2 Drawing Sheets

DUPLEX STAINLESS STEEL

CROSS-REFERENCE TO RELATED APPLICATIONS

This is a national stage application filed under 35 USC 371 based on International Application No. PCT/FI2015/050065 filed Feb. 2, 2015 and claims priority under 35 USC 119 of Finnish Patent Application No. 20145113 filed Feb. 3, 2014.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Does not apply.

This invention relates to a duplex ferritic austenitic stainless steel which has high formability with the TRIP (Transformation Induced Plasticity) effect and high corrosion resistance and optimized pitting resistance equivalent (PRE).

The transformation induced plasticity (TRIP) effect refers to the transformation of metastable retained austenite to martensite during plastic deformation as a result of imposed stress or strain. This property allows stainless steels having the TRIP effect to have a high formability, while retaining excellent strength.

It is known from the WO patent application 2011/135170 a method for manufacturing a ferritic-austenitic stainless steel having good formability and high elongation, which steel contains in weight % less than 0.05% C, 0.2-0.7% Si, 2-5% Mn, 19-20.5% Cr, 0.8-1.35% Ni, less than 0.6% Mo, less than 1% Cu, 0.16-0.24% N, the balance being iron and inevitable impurities. The stainless steel of the WO patent application 2011/135170 is heat treated so that the microstructure of the stainless steel contains 45-75% austenite in the heat treated condition, the remaining microstructure being ferrite. Further, the measured $M_{d30}$ temperature of the stainless steel is adjusted between 0 and 50° C. in order to utilize the TRIP effect for improving the formability of the stainless steel.

Furthermore, it is known from the WO patent application 2013/034804 a duplex ferritic austenitic stainless steel utilizing the TRIP effect, which contains less than 0.04 weight % C, less than 0.7 weight % Si, less than 2.5 weight % Mn, 18.5-22.5 weight % Cr, 0.8-4.5 weight % Ni, 0.6-1.4 weight % Mo, less than 1 weight % Cu, 0.10-0.24 weight % N, the rest being iron and inevitable impurities occurring in stainless steels. Sulphur is limited to less than 0.010 weight % and preferably less than 0.005 weight %, the phosphorus content is less than 0.040 weight % and the sum of sulphur and phosphorus (S+P) is less than 0.04 weight %, and the total oxygen content is below 100 ppm. The duplex stainless steel optionally contains one or more added elements in the following: the aluminium content is maximized to less than 0.04 weight % and preferably the maximum is less than 0.03 weight %. Further, boron, calcium and cerium are optionally added in small quantities; the preferred contents for boron and calcium are less than 0.003 weight % and for cerium less than 0.1 weight %. Optionally cobalt can be added up to 1 weight % for a partial replacement to nickel, and tungsten can be added up to 0.5 weight % as partial replacement to molybdenum. Also one or more of the group containing niobium, titanium and vanadium can be optionally added in the duplex stainless steel of the invention, the contents of niobium and titanium being limited up to 0.1 weight % and the vanadium content being limited up to 0.2 weight %.

According to the WO patent application 2013/034804 the pitting resistance equivalent (PRE) has been optimized to give good corrosion resistance, being at the range of 27-29.5. The critical pitting temperature (CPT) is in the range of 20-33° C., preferably 23-31° C. The TRIP (Transformation Induced Plasticity) effect in the austenite phase is maintained in accordance with the measured $M_{d30}$ temperature at the range of 0-90° C., preferably at the range of 10-70° C., in order to ensure the good formability. The proportion of the austenite phase in the microstructure of the duplex stainless steel of the invention is in the heat treated condition 45-75 volume %, advantageously 55-65 volume %, the rest being ferrite, in order to create favourable conditions for the TRIP effect. The heat treatment can be carried out using different heat treatment methods, such as solution annealing, high-frequency induction annealing or local annealing, at the temperature range from 900 to 1200° C., preferably from 950 to 1150° C.

BRIEF SUMMARY OF THE INVENTION

The object of the present invention is to improve the properties of the duplex stainless steels described in the prior art and to achieve a new duplex ferritic austenitic stainless steel utilizing the TRIP effect with high pitting resistance equivalent (PRE) and giving therefore superior corrosion resistance. The essential features of the invention are enlisted in the appended claims.

According to the invention, the duplex ferritic austenitic stainless steel contains less than 0.04 weight % C, 0.2-0.8 weight % Si, less than 2.0 weight % Mn, 16.5-19.5 weight % Cr, 3.0-4.7 weight % Ni, 1.0-4.0 weight % Mo, less than 3.5 weight % W, less than 1 weight % Cu, 0.13-0.26 weight % N, the rest being iron and inevitable impurities occurring in stainless steels. Sulphur is limited to less than 0.010 weight % and preferably less than 0.005 weight %, the phosphorus content is less than 0.040 weight % and the sum of sulphur and phosphorus (S+P) is less than 0.04 weight %, and the total oxygen content is below 100 ppm.

The duplex stainless steel of the invention optionally contains one or more added elements in the following: the aluminium content is maximized to less than 0.04 weight % and preferably the maximum is less than 0.03 weight %. Further, boron, calcium and cerium are optionally added in small quantities; the preferred contents for boron and calcium are less than 0.004 weight % and for cerium less than 0.1 weight %. Optionally cobalt can be added up to 1 weight % for a partial replacement to nickel. Also one or more of the group containing niobium, titanium and vanadium can be optionally added in the duplex stainless steel of the invention, the contents of niobium and titanium being limited up to 0.1 weight % and the vanadium content being limited up to 0.2 weight %.

According to the stainless steel of the invention, the pitting resistance equivalent (PRE) has been optimized to give good corrosion resistance, being at the range of 30-36. The critical pitting temperature (CPT) is in the range of 30-45° C., The TRIP (Transformation Induced Plasticity) effect in the austenite phase is maintained in accordance with the measured $M_{d30}$ temperature at the range of −30-90° C., preferably at the range of 10-60° C., in order to ensure the good formability. The $M_{d30}$-temperature, which is a measure for the austenite stability to the TRIP effect, is defined as the temperature at which 0.3 true strain yields 50% transformation of the austenite to martensite. The proportion of the austenite phase in the microstructure of the duplex stainless steel of the invention is in the heat treated condition 45-80 volume %, advantageously 55-70 volume %, the rest being ferrite, in order to create favourable conditions for the TRIP effect. The heat treatment can be carried out using different heat treatment methods, such as solution annealing, high-frequency induction annealing, local annealing or any other type of heat treatment at the temperature range from 900 to 1200° C., preferably from 950 to 1150° C.

Effects of different elements in the microstructure are described in the following, the element contents being described in weight %:

Carbon (C) partitions to the austenite phase and has a strong effect on austenite stability. Carbon can be added up to 0.04% but higher levels have detrimental influence on corrosion resistance.

Nitrogen (N) is an important austenite stabilizer in duplex stainless steels and like carbon it increases the stability against martensite. Nitrogen also increases strength, strain hardening and corrosion resistance. The general empirical expressions on the $M_{d30}$ temperature indicate that nitrogen and carbon have the same strong influence on austenite stability. Because nitrogen can be added to stainless steels in larger extent than carbon without adverse effects on corrosion resistance the nitrogen contents from 0.13 up 0.26% are effective in present stainless steels. For the optimum property profile, the nitrogen content of 0.16-0.25% is preferable.

Silicon (Si) is normally added to stainless steels for deoxidizing purposes in the melt shop and should not be below 0.2%. Silicon stabilizes the ferrite phase in duplex stainless steels but has a stronger stabilizing effect on austenite stability against martensite formation than shown in current expressions. For this reason silicon is maximized to 0.8%, preferably to 0.5%.

Manganese (Mn) is an important addition to stabilize the austenite phase and to increase the solubility of nitrogen in the stainless steel. Manganese can partly replace the expensive nickel and bring the stainless steel to the right phase balance. Too high level in the content will reduce the corrosion resistance.

Manganese has a stronger effect on austenite stability against deformation martensite and, therefore, the manganese content must be carefully addressed. The range of manganese shall be less than 2.0%, preferably less than 1.0%.

Chromium (Cr) is the main addition to make the steel resistant to corrosion. Being ferrite stabilizer chromium is also the main addition to create a proper phase balance between the austenite phase and the ferrite phase. To bring about these functions the chromium level should be at least 16.5%. Further, chromium strongly increases the resistance to martensite formation and, therefore, reduces the TRIP effect. For this purpose the maximum content should be 19.5%. Preferably the chromium content is 16.5-18.8%.

Nickel (Ni) is an essential alloying element for stabilizing the austenite phase and for good ductility and at least 3.0% must be added to the stainless steel of the invention. Having a large influence on austenite stability against martensite formation nickel has to be present in a narrow range. Further, because of nickel's high cost and price fluctuation nickel should be maximized in the stainless steel of the invention to 4.7%, preferably to 4.5%

Copper (Cu) is normally present as a residual of 0.1-0.5% in most stainless steels, when the raw materials to a great deal are in the form of stainless scrap containing this element. Copper is a weak stabilizer of the austenite phase but has a strong effect on the resistance to martensite formation and must be considered in evaluation of formability of the present stainless steels. An intentional addition up to 1.0% can be made, but preferably the copper content is up to 0.7%, more preferably up to 0.5%.

Molybdenum (Mo) is a ferrite stabilizer that can be added to increase the corrosion resistance and, therefore, molybdenum shall have a content at least 1.0%, preferably at least 1.5%. Further, molybdenum, like chromium, strongly increases the resistance to martensite formation and reduces the TRIP effect. Therefore, molybdenum cannot be added to more than 4.0%.

Tungsten (W) has similar properties as molybdenum and can sometimes replace molybdenum. However, tungsten and molybdenum promote sigma phase precipitation and the sum of the molybdenum and tungsten contents according to the formula (Mo+0.5W) should be less than 4.0%, preferably 2.2-3.8%, where the promotion of sigma and chi phases are possible to handle in technically relevant processes. The most important influence of tungsten is the surprisingly positive impact on the TRIP effect which in turn could be related to the effect on the stacking fault energy of the alloy since the stacking fault energy controls the deformation response in terms of dislocation glide, twinning or martensite formation. For this purpose, tungsten should be limited up to 3.5%, but preferably at least 1.0% when tungsten is used to replace molybdenum.

Boron (B), calcium (Ca) and cerium (Ce) are added in small quantities in duplex steels to improve hot workability and not at too high contents as this can deteriorate other properties. The preferred contents for boron and calcium in the stainless steel of the invention are less than 0.004% and for cerium less than 0.1%.

Sulphur (S) in duplex steels deteriorates hot workability and can form sulphide inclusions that influence pitting corrosion resistance negatively. The content of sulphur should therefore be limited to less than 0.010% and preferably less than 0.005%.

Phosphorus (P) deteriorates hot workability and can form phosphide particles or films that influence corrosion resistance negatively. The content of phosphorus should therefore be limited to less than 0.040%, and so that the sum of sulphur and phosphorus (S+P) contents is less than 0.04%.

Oxygen (O) together with other residual elements has an adverse effect on hot ductility. The presence of oxide inclusions may reduce corrosion resistance (pitting corrosion) depending on type of inclusion. High oxygen content also reduces impact toughness. In a similar manner as sulphur oxygen improves weld penetration by changing the surface energy of the weld pool. For the stainless steel of the invention the advisable maximum oxygen level is below 100 ppm. In a case of a metallic powder the maximum oxygen content can be up to 250 ppm.

Aluminium (Al) should be kept at a low level in the duplex stainless steel of the invention with high nitrogen content as these two elements can combine and form aluminium nitrides that will deteriorate the impact toughness. The aluminium content is limited to less than 0.04% and preferably to less than 0.03%.

Cobalt (Co) has similar metallurgical behaviour as its sister element, nickel, and cobalt may be treated in much the same way in steel and alloy production. Cobalt inhibits grain growth at elevated temperatures and considerably improves the retention of hardness and hot strength. Cobalt increases the cavitation erosion resistance and the strain hardening. Cobalt reduces the risk of sigma phase formation in super duplex stainless steels. The cobalt content is limited up to 1.0%.

The "micro-alloying" elements titanium (Ti), vanadium (V) and niobium (Nb) belong to a group of additions so named because they significantly change the steels properties at low concentrations, often with beneficial effects in carbon steel but in the case of duplex stainless steels they also contribute to undesired property changes, such as reduced impact properties, higher surface defects levels and reduced ductility during casting and hot rolling. Many of these effects depend on their strong affinity for carbon and in particular nitrogen in the case of modern duplex stainless steels. In the present invention niobium and titanium should be limited to maximum level of 0.1% whereas vanadium is less detrimental and should be less than 0.2%.

BRIEF DESCRIPTION OF THE SEVERAL VIEWS OF THE DRAWINGS

The present invention is described in more details referring to the drawings where.

DETAILED DESCRIPTION OF THE INVENTION

Figure 1:
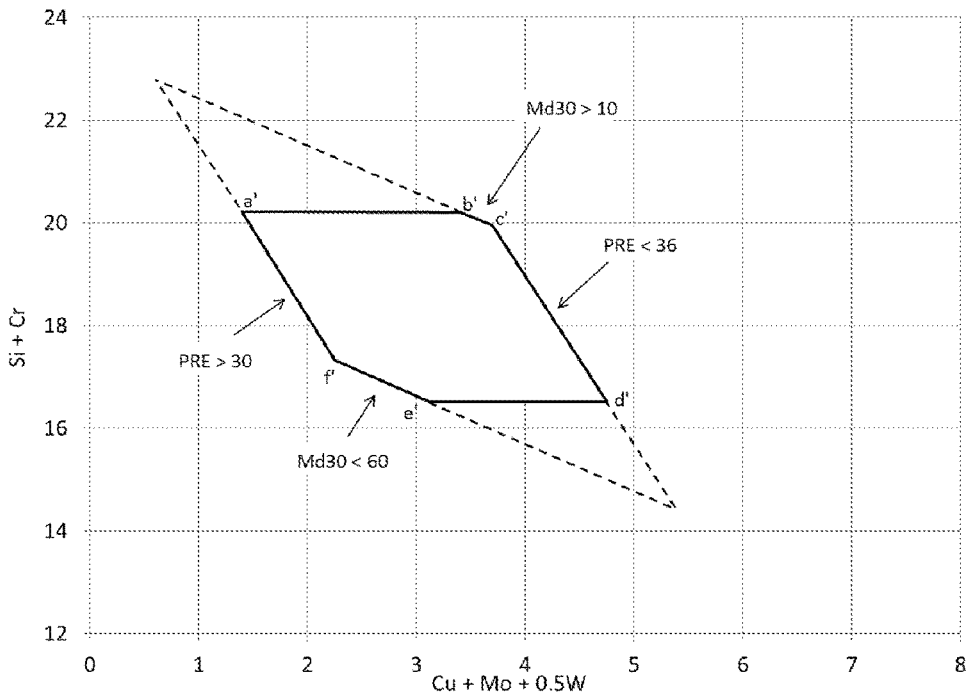
FIG. 1 illustrates the dependence of the minimum and maximum $M_{d30}$ temperature and PRE values between the element contents Si+Cr and Cu+Mo+0.5W in the tested alloys of the invention.

Based on the effects of the elements the duplex ferritic austenitic stainless steel according to the invention is presented with the chemical compositions A to P as named in the table 1. The table 1 contains also the chemical composition for the reference duplex stainless steels of the WO patent application 2011/135170 named as R and the WO patent application 2013/034804 named as Q, all the contents of the table 1 in weight %.

TABLE 1

| Alloy | C % | Si % | Mn % | Cr % | Ni % | Cu % | N % | Mo % | W % |
|---|---|---|---|---|---|---|---|---|---|
| A | 0.021 | 0.54 | 0.62 | 17.61 | 4.25 | 0.41 | 0.181 | 1.59 | 3.08 |
| B | 0.023 | 0.48 | 0.65 | 17.85 | 4.31 | 0.43 | 0.189 | 1.65 | 1.5 |
| C | 0.024 | 0.51 | 0.72 | 18.16 | 4.04 | 0.42 | 0.201 | 2.26 | |
| D | 0.029 | 0.48 | 0.75 | 18.24 | 3.32 | 0.42 | 0.225 | 2.27 | |
| E | 0.027 | 0.53 | 1.6 | 18.75 | 3.42 | 0.39 | 0.191 | 2.56 | |
| F | 0.029 | 0.5 | 0.73 | 18.34 | 3.4 | 0.43 | 0.215 | 2.57 | |
| G | 0.027 | 0.53 | 1.62 | 18.67 | 3.42 | 0.39 | 0.171 | 2.68 | |
| H | 0.023 | 0.54 | 0.61 | 16.99 | 4.38 | 0.44 | 0.176 | 2.73 | 1.92 |
| I | 0.027 | 0.52 | 0.68 | 17.98 | 3.6 | 0.31 | 0.23 | 2.96 | |
| J | 0.026 | 0.55 | 1.54 | 18.19 | 3.27 | 0.48 | 0.168 | 2.97 | |
| K | 0.022 | 0.57 | 1.31 | 18.58 | 3.28 | 0.48 | 0.178 | 3.11 | |
| L | 0.022 | 0.46 | 0.69 | 18.14 | 4.38 | 0.44 | 0.185 | 3.33 | |
| M | 0.031 | 0.58 | 1.54 | 18.19 | 3.78 | 0.42 | 0.174 | 3.72 | |
| N | 0.024 | 0.57 | 1.52 | 18.29 | 3.81 | 0.42 | 0.193 | 3.72 | |
| O | 0.028 | 0.53 | 0.71 | 16.98 | 3.45 | 0.43 | 0.208 | 3.76 | |
| P | 0.027 | 0.47 | 0.76 | 17.31 | 3.44 | 0.43 | 0.187 | 3.77 | |
| Q | 0.04 | 0.40 | 3.0 | 20.2 | 1.2 | 0.40 | 0.22 | 0.40 | |
| R | 0.026 | 0.46 | 0.99 | 20.08 | 3.03 | 0.36 | 0.178 | 1.19 | |

The alloys A-P were manufactured in a vacuum induction furnace in 1 kg laboratory scale to small slabs that were forged and cold rolled down to 1.5 mm thickness.

The referred alloys Q and R were produced in 100 ton production scale followed by hot rolling and cold rolling to coil form with varying final dimensions.

When comparing the values in the Table 1 the contents of chromium, nickel, molybdenum and tungsten in the duplex stainless steels of the invention are significantly different from the reference stainless steels Q and R.

The properties, the values for the $M_{d30}$ temperature, the critical pitting temperature (CPT) and PRE were determined for the chemical compositions of the table 1 and the results are presented in the following table 2.

The predicted $M_{d30}$ temperature ($M_{d30}$ Nohara) of the austenite phase in the table 2 was calculated using the Nohara expression (1) established for austenitic stainless steels $$M_{d30}=551-462(C+N)-9.2Si-8.1Mn-13.7Cr-29(Ni+Cu)-18.5Mo-68Nb \quad (1)$$

when annealed at the temperature of 1050° C.

The actual measured $M_{d30}$ temperatures ($M_{d30}$ measured) of the table 2 were established by straining the tensile samples to 0.30 true strain at different temperatures and by measuring the fraction of the transformed martensite with Satmagan equipment. Satmagan is a magnetic balance in which the fraction of ferromagnetic phase is determined by placing a sample in a saturating magnetic field and by comparing the magnetic and gravitational forces induced by the sample.

The calculated $M_{d30}$ temperatures ($M_{d30}$ calc) in the table 2 were achieved in accordance with a mathematical constraint of optimization.

The critical pitting temperature (CPT) is measured in a 1M sodium chloride (NaCl) solution according to the ASTM G150 test, and below this critical pitting temperature (CPT) pitting is not possible and only passive behaviour is seen.

The pitting resistance equivalent (PRE) is calculated using the formula (2):

$$PRE=\%\ Cr+3.3*(\%\ Mo+0.5\%\ W)+30*\%\ N-\%\ Mn \quad (2).$$

The sums of the element contents for C+N, Cr+Si, Cu+Mo+0.5W and Mn+Ni in weight % are also calculated for the alloys of the table 1 in the table 2. The sums C+N and Mn+Ni represent austenite stabilizers, while the sum Si+Cr represents ferrite stabilizers and the sum Cu+Mo+0.5W elements having resistance to martensite formation.

TABLE 2

| Alloy | C + N % | Si + Cr % | Mn + Ni % | Cu + Mo + 0.5W % | $M_{d30}$ calc ° C. | $M_{d30}$ Nohara ° C. | $M_{d30}$ measured ° C. | CPT ° C. | PRE |
|---|---|---|---|---|---|---|---|---|---|
| A | 0.202 | 18.15 | 4.87 | 3.54 | 22.8 | 41.9 | — | 39.2 | 32.7 |
| B | 0.212 | 18.33 | 4.96 | 2.83 | 33.7 | 30.8 | — | 38.2 | 30.8 |
| C | 0.225 | 18.67 | 4.76 | 2.68 | 30.7 | 16.6 | 18 | 36.6 | 30.9 |
| D | 0.254 | 18.72 | 4.07 | 2.69 | 40.5 | 22.8 | 54.9 | — | 31.7 |
| E | 0.218 | 19.28 | 5.02 | 2.95 | 1.0 | 17.7 | 2 | 35.5 | 31.3 |
| F | 0.244 | 18.84 | 4.13 | 3 | 28.4 | 17.9 | 32.7 | — | 32.5 |
| G | 0.198 | 19.2 | 5.04 | 3.07 | 1.6 | 25.7 | — | — | 31.0 |
| H | 0.199 | 17.53 | 4.99 | 4.13 | 22.8 | 26.1 | — | 37.2 | 33.8 |
| I | 0.257 | 18.5 | 4.28 | 3.27 | 26.7 | 7.5 | 34 | 34.6 | 34.0 |
| J | 0.194 | 18.74 | 4.81 | 3.45 | 10.0 | 30.9 | 0 | | 31.5 |
| K | 0.2 | 19.15 | 4.59 | 3.59 | −1.6 | 21.6 | — | 39.8 | 32.9 |
| L | 0.207 | 18.6 | 5.07 | 3.77 | −1.1 | −4.4 | — | — | 34.0 |
| M | 0.205 | 18.77 | 5.32 | 4.14 | −21.0 | −1.3 | −29 | — | 34.1 |
| N | 0.217 | 18.86 | 5.33 | 4.14 | −25.0 | −8.9 | — | 45.1 | 34.8 |
| O | 0.236 | 17.51 | 4.16 | 4.19 | 35.4 | 16.6 | 41.6 | — | 34.9 |
| P | 0.214 | 17.78 | 4.2 | 4.2 | 28.8 | 22.5 | 34 | 34.8 | 34.6 |
| Q | 0.26 | 20.7 | 4.3 | 1.0 | 24.9 | 23 | 27 | <10 | 25 |
| R | 0.204 | 20.54 | 4.02 | 1.55 | 29.6 | 5 | 19 | 30.0 | 28.4 |

When comparing the values in the Table 2 the PRE value having the range of 30-36 is much higher than the PRE value in the referred duplex stainless steels Q and R which means that the corrosion resistance of the alloys A-P is higher. The critical pitting temperature CPT is in the range of 34-45° C., which is much higher than the CPT for the referred duplex stainless steels Q and R and further for instance for austenitic stainless steels, such as EN 1.4401 and similar grades.

The predicted $M_{d30}$ temperatures using the Nohara expression (1) are essentially different from the measured $M_{d30}$ temperatures for the alloys on the table 2. Further, from the table 2 it is noticed that the calculated $M_{d30}$ temperatures agree well with the measured $M_{d30}$ temperatures, and the mathematical constraint of optimization used for the calculation is thus very suitable for the duplex stainless steels of the invention.

The sums of the element contents for C+N, Si+Cr, Mn+Ni and Cu+Mo+0.5W in weight % for the duplex stainless steel of the present invention were used in the mathematical constraint of optimization to establish the dependence in one hand between C+N and Mn+Ni, and in another hand between Si+Cr and Cu+Mo+0.5W. In accordance with this mathematical constraint of optimization the sums of Cu+Mo+0.5W and Si+Cr, respectively the sums Mn+Ni and C+N, form the x and y axis of a coordination in the FIGS. 1-4 where the linear dependence for the minimum and maximum PRE values (30<PRE<36) and for the minimum and maximum $M_{d30}$ temperature ($10<M_{d30}<60$) values are defined.

In accordance with FIG. 1 a chemical composition window for Si+Cr and Cu+Mo+0.5W is established with the preferred ranges of 0.16-0.29 for C+N and 3.0-5.5 for Mn+Ni when the duplex stainless steel of the invention was annealed at the temperature of 1050° C. It is also noticed in FIG. 1 that the sum Si+Cr is limited to 16.5<Si+Cr<20.2 in accordance with the stainless steel of the invention.

The chemical composition window, which lies within the frame of the area a', b', c', d', e', f' and g' in FIG. 1, is defined with the following labelled positions of the coordination in the table 3.

TABLE 3

| | Si + Cr % | Cu + Mo + 0.5W % | C + N % | Mn + Ni % |
|---|---|---|---|---|
| a' | 20.2 | 1.4 | 0.29 | 4.5 |
| b' | 20.2 | 3.4 | 0.16 | 3.0 |
| c' | 19.9 | 3.7 | 0.16 | 3.0 |
| d' | 16.5 | 4.75 | 0.16 | 4.0 |
| e' | 16.5 | 3.15 | 0.29 | 5.5 |
| f' | 17.3 | 2.27 | 0.29 | 5.5 |

Figure 2:
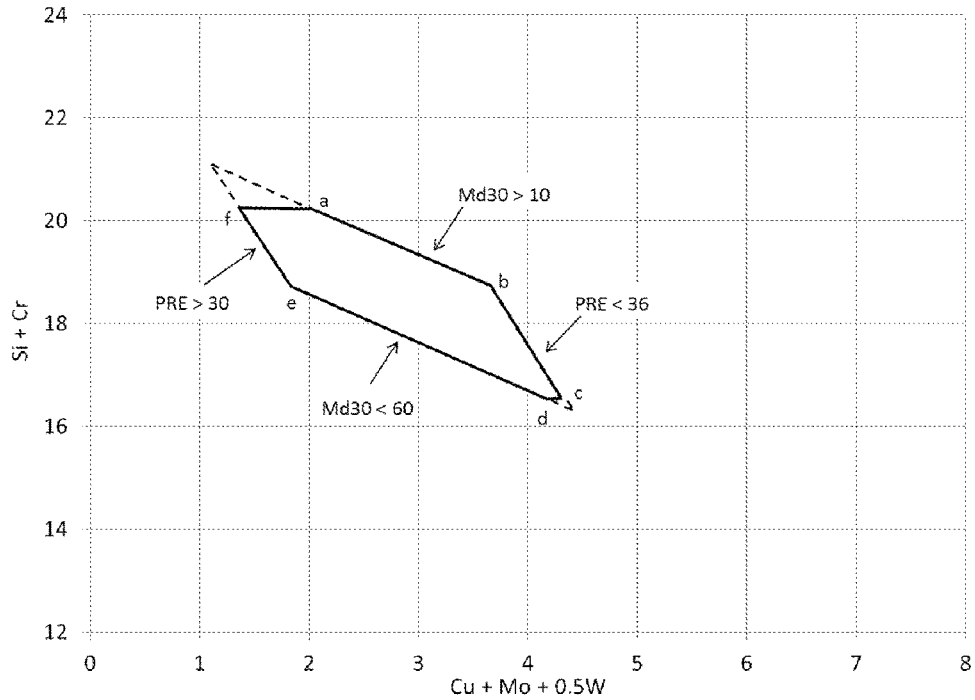
FIG. 2 illustrates an example with constant values of C+N and Mn+Ni for the dependence of the minimum and maximum $M_{d30}$ temperature and PRE values between the element contents Si+Cr and Cu+Mo+0.5W in the tested alloys of the invention according to FIG. 1.

FIG. 2 illustrates one chemical composition example window of FIG. 1 when constant values of 0.257 for C+N and 4.28 for Mn+Ni are used at all points instead of the ranges for C+N and Mn+Ni in FIG. 1. The same limitations are given to the sum of Si+Cr in FIG. 2 as in FIG. 1. The chemical composition window, which lies within the frame of the area a, b, c, d, e, f and g in FIG. 2, is defined with the following labelled positions of the coordination in the table 4.

TABLE 4

| | Si + Cr % | Cu + Mo + 0.5W % | C + N % | Mn + Ni % |
|---|---|---|---|---|
| a | 20.2 | 2.0 | 0.257 | 4.28 |
| b | 18.7 | 3.7 | 0.257 | 4.28 |
| c | 16.5 | 4.35 | 0.257 | 4.28 |
| d | 16.5 | 4.2 | 0.257 | 4.28 |
| e | 18.7 | 1.85 | 0.257 | 4.28 |
| f | 20.2 | 1.4 | 0.257 | 4.28 |

Figure 3:
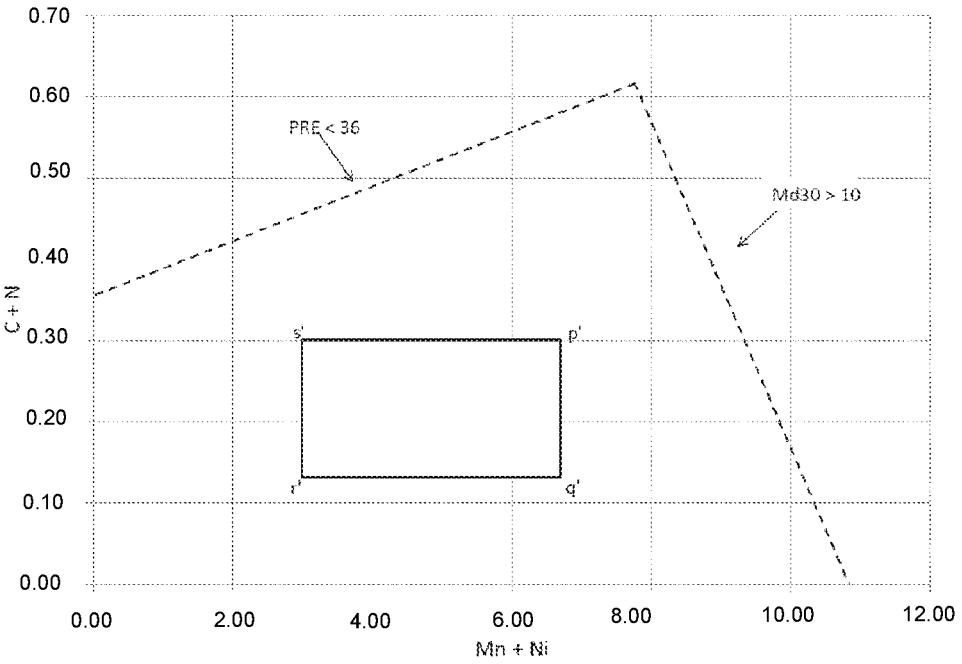
FIG. 3 illustrates the dependence of the minimum and maximum $M_{d30}$ temperature and PRE values between the element contents C+N and Mn+Ni in the tested alloys of the invention.

FIG. 3 illustrates a chemical composition window for C+N and Mn+Ni with the preferred composition ranges 16.9-19.5 for Cr+Si and 2.0-4.0 for Cu+Mo+0.5W, when the duplex stainless steel was annealed at the temperature of 1050° C. Further, in accordance with invention the sum C+N is limited to 0.13<C+N<0.30 and the sum Mn+Ni is limited to 3.0<Mn+Ni<6.7. The chemical composition window, which lies within the frame of the area p', q' r' and s' in FIG. 3, is defined with the following labelled positions of the coordination in the table 5.

TABLE 5

| | Si + Cr % | Cu + Mo + 0.5W % | C + N % | Mn + Ni % |
|---|---|---|---|---|
| p' | 17.2 | 2.5 | 0.3 | 6.7 |
| q' | 16.9 | 4.0 | 0.13 | 6.7 |
| r' | 18.71 | 4.0 | 0.13 | 3.0 |
| s' | 19.5 | 2.0 | 0.3 | 3.0 |

The effect of the limitations for C+N and Mn+Ni with the preferred ranges for the element contents of the invention is that the chemical composition window of FIG. 3 is partly limited solely by the limitations for the minimum and maximum sums of C+N and Mn+Ni.

Figure 4:
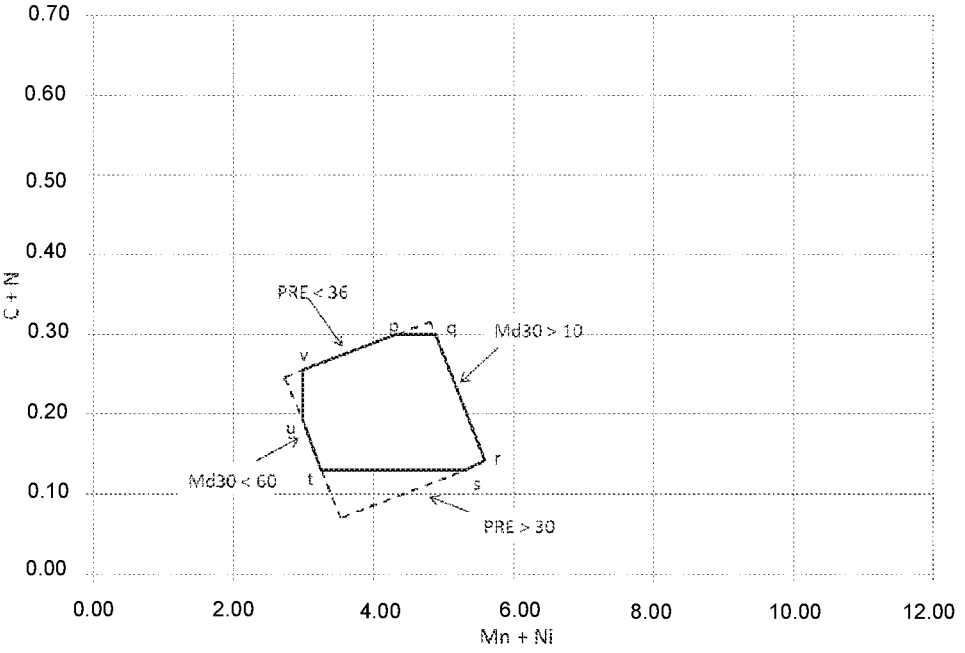
FIG. 4 illustrates an example with constant values of Si+Cr and Cu+Mo+0.5W for the dependence of the minimum and maximum $M_{d30}$ temperature and PRE values between the element contents C+N and Mn+Ni in the tested alloys of the invention according to FIG. 3.

FIG. 4 illustrates one chemical composition example window of FIG. 3 with the constant values of 18.5 for Cr+Si and 3.27 for Cu+Mo+0.5W and further, with the limitations of 0.13<C+N<0.30 and 3.0<Mn+Ni. The chemical composition window, which lies within the frame of the area p, q, r, s, t, u and v in FIG. 4, is defined with the following labelled positions of the coordination in the table 6.

TABLE 6

| | Si + Cr % | Cu + Mo + 0.5W % | C + N % | Mn + Ni % |
|---|---|---|---|---|
| p | 18.5 | 3.27 | 0.30 | 4.4 |
| q | 18.5 | 3.27 | 0.30 | 4.9 |
| r | 18.5 | 3.27 | 0.14 | 5.6 |
| s | 18.5 | 3.27 | 0.13 | 5.2 |
| t | 18.5 | 3.27 | 0.13 | 3.3 |
| u | 18.5 | 3.27 | 0.19 | 3.0 |
| v | 18.5 | 3.27 | 0.26 | 3.0 |

The alloys of the present invention A-P as well as the reference materials Q and R above were further tested by determining the yield strengths $R_{p0.2}$ and $R_{p1.0}$ and the tensile strength $R_m$ as well as the elongation values for $A_{50}$, $A_5$ and $A_g$ in the longitudinal direction. The table 7 contains the results of the tests for the alloys A-P of the invention as well as the respective values for the reference duplex stainless steels Q and R.

TABLE 7

| Alloy | $R_{p0.2}$ (MPa) | $R_{p1.0}$ (MPa) | $R_m$ (MPa) | $A_{50}$ (%) | $A_5$ (%) | $A_g$ (%) |
|---|---|---|---|---|---|---|
| A | 454 | 534 | 755 | 43.0 | 46.0 | 33.4 |
| B | 439 | 518 | 743 | 42.5 | 45.0 | 32.8 |
| C | 491 | 577 | 760 | 43.3 | 40.7 | 32.8 |
| D | 430 | 498 | 862 | 39.3 | 41.8 | 34.7 |
| E | — | — | — | — | — | — |
| F | 432 | 512 | 823 | 41 | 43.5 | 36.6 |
| G | 476 | 538 | 725 | 36.7 | 40.0 | 25.4 |
| H | 440 | 525 | 742 | 47.9 | 51.2 | 41.0 |
| I | 471 | 536 | 853 | 42.7 | 45.3 | 37.7 |
| J | — | — | — | — | — | — |
| K | 471 | 557 | 721 | 30.7 | 32.9 | 19.8 |
| L | 427 | 535 | 743 | 45.1 | 48.1 | 38.6 |
| M | — | — | — | — | — | — |
| N | 453 | 537 | 732 | 36.8 | 39.6 | 24.4 |
| O | 474 | 565 | 765 | 45.7 | 49.5 | 32.0 |
| P | 452 | 534 | 800 | 46.1 | 49.6 | 39.4 |
| Q | 498.0 | 544.0 | 787.0 | 45.2 | 49.0 | 40 |
| R | 562 | 626 | 801 | 40.4 | 44.3 | 35.5 |

The results in the table 7 show that the yield strength values $R_{p0.2}$ and $R_{p1.0}$ for the alloys A-P are lower than the respective values for the reference duplex stainless steels Q and R, and the tensile strength value $R_m$ is similar to the reference duplex stainless steels Q and R. The elongation values $A_{50}$, $A_5$ and $A_g$ of the alloys A-P are lower than the respective values for the reference stainless steels Q and R. Because the alloys A-P according to the invention are manufactured in the laboratory scale and the reference duplex stainless steels Q and R are produced in the production scale, the strength values of the table 7 are not directly comparable with each other.

The duplex ferritic austenitic stainless steel of the invention can be produced as ingots, slabs, blooms, billets and flat products such as plates, sheets, strips, coils, and long products such as bars, rods, wires, profiles and shapes, seamless and welded tubes and/or pipes. Further, additional products such as metallic powder, formed shapes and profiles can be produced.

The invention claimed is:

1. A duplex ferritic austenitic TRIP stainless steel having a proportion of austenite phase in a microstructure of the duplex stainless steel of 55-70 volume %, the rest being ferrite, having undergone heat treatment at a temperature range of 900-1200° C., wherein the duplex ferritic austenitic TRIP stainless steel includes greater than 0 and less than 0.04 weight % carbon, 0.2-0.8 weight % silicon, greater than 0 and less than 2.0 weight % manganese, 16.5-19.5 weight % chromium, 3.0-4.7 weight % nickel, 1.5-4.0 weight % molybdenum, greater than 0 and less than 3.5 weight % tungsten, greater than 0 and less than 1 weight % copper, 0.13-0.26 weight % nitrogen, the rest being iron and inevitable impurities occurring in stainless steels;

the duplex ferritic austenitic TRIP stainless steel has a pitting resistance equivalent value (PRE) of the duplex stainless steel is 30-36, the PRE calculated as follows: PRE=Cr+3.3(Mo+0.5 W)+30 N—Mn, wherein Cr, Mo, W, N and Mn are expressed in weight %;

the duplex ferritic austenitic TRIP stainless steel has a critical pitting temperature CPT in the range of 34-45° C., where the CPT is measured in a 1 M sodium chloride (NaCl) solution according to ASTM G150 test;

the duplex ferritic austenitic TRIP stainless steel has a yield strength value ($R_{p0.2}$) of 430-471 MPa; and the duplex ferritic austenitic TRIP stainless steel has a predicted $M_{d30}$ temperature (Moo Nohara) of the austenite phase of −9° C. to 42° C. calculated as follows: $M_{d30}$ Nohara=551−462(C+N)−9.2Si−8.1Mn−13.7Cr−29(Ni+Cu)−185.Mo−68Nb.

2. A duplex ferritic austenitic TRIP stainless steel having a proportion of austenite phase in a microstructure of the duplex stainless steel of 55-70 volume %, the rest being ferrite, having undergone heat treatment at a temperature range of 900-1200° C., wherein:

the duplex ferritic austenitic TRIP stainless steel includes greater than 0 and less than 0.04 weight % carbon, 0.2-0.8 weight % silicon, greater than 0 and less than 2.0 weight % manganese, 16.5-19.5 weight % chromium, 3.0-4.7 weight % nickel, 1.5-4.0 weight % molybdenum, greater than 0 and less than 3.5 weight % tungsten, greater than 0 and less than 1 weight % copper, 0.13-0.26 weight % nitrogen, the rest being iron and inevitable impurities occurring in stainless steels;

the duplex ferritic austenitic TRIP stainless steel includes 16.9<(Si+Cr)<19.5, 2.0<(Cu+Mo+0.5W)<4.0, 0.16<(C+N)<0.29, 3.0<(Mn+Ni)<5.5, wherein Si, Cr, Cu, Mo, W, C, N, Mn and Ni are expressed in weight %;

the duplex ferritic austenitic TRIP stainless steel has a measured $M_{d30}$ temperature greater than 10° C. and less than 60° C.; the measured $M_{d30}$ temperature defined as the temperature at which 0.3 true strain yields 50% transformation of the austentite to martensite, the fraction of the transformed martensite measured with Satmagan equipment; and the duplex ferritic austenitic TRIP stainless steel has a pitting resistance equivalent value (PRE) of the duplex stainless steel is 30-36, the PRE calculated as follows: PRE=Cr+3.3(Mo+0.5 W)+30 N—Mn, wherein Cr, Mo, W, N and Mn are expressed in weight %;

the duplex ferritic austenitic TRIP stainless steel has a critical pitting temperature CPT in the range of 34-45° C., where the CPT is measured in a 1 M sodium chloride (NaCl) solution according to ASTM G150 test.

3. The duplex ferritic austenitic TRIP stainless steel according to claim 1, wherein the chromium content is 16.5-18.8 weight %.

4. The duplex ferritic austenitic TRIP stainless steel according to claim 1, wherein the nickel content is 3.0-4.5 weight %.

5. The duplex ferritic austenitic TRIP stainless steel according to claim 1, wherein the manganese content is greater than 0 and less than 1.0 weight %.

6. The duplex ferritic austenitic TRIP stainless steel according to claim 1, wherein the copper content is greater than 0 and less than 0.7 weight %.

7. The duplex ferritic austenitic TRIP stainless steel according to claim 1, wherein the tungsten content is 1—less than 3.5 weight %.

8. The duplex ferritic austenitic TRIP stainless steel according to claim 1, wherein the sum of the molybdenum (Mo) and tungsten (W) contents according to the formula (Mo+0.5W) is less than 4.0 weight %.

9. The duplex ferritic austenitic TRIP stainless steel according to claim 1, wherein the nitrogen content is 0.16-0.25 weight %.

10. The duplex ferritic austenitic TRIP stainless steel according to claim 1, characterized in that the steel is produced in a form selected from a group consisting of ingots, slabs, blooms, billets, plates, sheets, strips, coils, bars, rods, wires, profiles and shapes, seamless and welded tubes and/or pipes, metallic powder, formed shapes and profiles.

11. The duplex ferritic austenitic TRIP stainless steel according to claim 1, wherein:

the duplex ferritic austenitic TRIP stainless steel has a tensile strength (Rm) of 721-765 MPa; and the duplex ferritic austenitic TRIP stainless steel has a yield strength values ($R_{p1.0}$) of 512-538 MPa.

12. The duplex ferritic austenitic TRIP stainless steel according to claim 2, wherein the duplex ferritic austenitic TRIP stainless steel has a yield strength value ($R_{p0.2}$) of 430-471 MPa.

* * * * *